US007494391B2

(12) United States Patent
Okabe

(10) Patent No.: US 7,494,391 B2
(45) Date of Patent: Feb. 24, 2009

(54) PROPULSION UNIT FOR OUTBOARD MOTOR

(75) Inventor: Yoshihiko Okabe, Shizuoka-ken (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/771,842

(22) Filed: Jun. 29, 2007

(65) Prior Publication Data

US 2008/0009207 A1 Jan. 10, 2008

(30) Foreign Application Priority Data

Jun. 29, 2006 (JP) ..... 2006-179594

(51) Int. Cl.
*B63H 23/34* (2006.01)

(52) U.S. Cl. ..... 440/83

(58) Field of Classification Search ..... 440/83
See application file for complete search history.

(56) References Cited

U.S. PATENT DOCUMENTS 5,643,025 A * 7/1997 Suzuki ..... 440/75
5,697,821 A * 12/1997 Ogino ..... 440/80

FOREIGN PATENT DOCUMENTS

JP 57-182595 11/1982
JP 2863601 3/1999

OTHER PUBLICATIONS

U.S. Appl. No. 11/771,780, filed Jun. 29, 2007, entitled Propulsion Unit For Marine Drive.

* cited by examiner

*Primary Examiner*—Stephen Avila
(74) *Attorney, Agent, or Firm*—Knobbe, Martens, Olson & Bear, LLP

(57) ABSTRACT

A lubricant circulating system has a lubricant passage formed in a propeller shaft. The lubricant passage extends axially along the propeller shaft from a bevel gear mechanism to a position proximate to a journal of the propeller shaft. The journal of the propeller shaft is rotatably supported by a bearing. The lubricant passage further extends radially of the propeller shaft and communicates with an area proximate to the bearing. The lubricant circulating system is adapted such that lubricant circulates through the lubricant passage between an upstream opening of the lubricant passage at or around the bevel gear mechanism and a downstream opening of the lubricant passage in the vicinity of the bearing.

13 Claims, 4 Drawing Sheets

PROPULSION UNIT FOR OUTBOARD MOTOR

CROSS-REFERENCE TO RELATED APPLICATIONS

The present application is based on and claims priority under 35 U.S.C. § 119 to Japanese Patent Application Serial No. 2006-179594, filed on Jun. 29, 2006, the entire contents of which are expressly incorporated by reference herein.

BACKGROUND OF THE INVENTION

1. Field

The present invention relates to an outboard motor, and more specifically to an outboard motor having a system for distributing lubricant in a lower casing of the outboard motor.

2. Description of Related Art

In outboard motors designed for small watercrafts or the like, the driving force from an engine is transmitted from a drive shaft to a propeller shaft via a bevel gear mechanism to produce propulsion force.

In this type of outboard motor, a lower casing for holding the drive shaft, bevel gear mechanism and propeller shaft therein is subjected to a reaction force directly from water when the outboard motor is driven in water. Thus, the lateral width of the lower casing is typically kept very small. Accordingly, the bevel gear mechanism and the other parts described above are disposed in a limited space within the lower casing.

To prolong the life of meshing parts of the bevel gear mechanism and bearings of the propeller shaft, lubricant is circulated in the lower casing to cool and lubricate such parts.

According to Japan Patent No. 2863601, for example, the propeller shaft has an oil passage formed therein. The oil passage extends axially along the propeller shaft from a front end of a bevel gear mechanism attachment part of the propeller shaft to a rear end thereof, and further extends radially of the propeller shaft and is open upward. Lubricant can thus circulate through the oil passage between the front end and the rear end of the bevel gear mechanism attachment part.

However, in a conventional outboard motor in which lubricant circulates between the front end and the rear end of the bevel gear mechanism attachment part of the propeller shaft, part of the lubricant lubricating a bearing at a rear end of the propeller shaft may stagnate, resulting in decreased bearing life.

SUMMARY

Accordingly, there is a need in the art for an outboard motor in which lubricant can circulate between a bevel gear mechanism attachment part and a rear bearing of a propeller shaft, without increasing a lower casing in size.

In accordance with one embodiment, the present invention provides an outboard motor comprising an engine and a propulsion unit. The propulsion unit comprises a drive shaft driven by the engine, a bevel gear mechanism, a propeller shaft driven by the drive shaft via the bevel gear mechanism, and a lower casing. The lower casing is adapted to support the propeller shaft, bevel gear mechanism, and drive shaft. The propeller shaft has a projection projecting generally rearward from the lower casing. A propeller shaft bearing rotatably supports the propeller shaft generally proximate the propeller shaft projection. A lubricant circulation system is adapted to circulate lubricant between the propeller shaft bearing and the bevel gear mechanism. The lubricant circulation system comprises a lubricant passage extending axially within the propeller shaft from a bevel gear mechanism attachment part of the propeller shaft to an axial terminus proximate to the propeller shaft bearing. The lubricant passage further extends radially within the propeller shaft from the axial terminus to a downstream opening at or adjacent the propeller shaft bearing. The lubricant circulation system is adapted to circulate lubricant through the lubricant passage from the bevel gear mechanism to the propeller shaft bearing.

In another embodiment, an upstream opening of the lubricant passage is provided in the bevel gear mechanism attachment part of the propeller shaft. In one such embodiment, the bevel gear mechanism comprises a forward bevel gear and a reverse bevel gear, each gear being attached to the propeller shaft, and the upstream opening of the lubricant passage communicates with an area between the forward and reverse bevel gears in the propeller shaft.

In yet another embodiment, the lubricant circulation system additionally comprises a return passage formed in a gap between the propeller shaft and an inner peripheral wall of a propeller shaft bore in the lower casing and extending from the downstream opening of the lubricant passage to the bevel gear mechanism attachment part.

Still another embodiment additionally comprises a drive shaft bearing for rotatably supporting the drive shaft, and the lubricant circulation system further comprises a bypass passage and a return passage, wherein the bypass passage is adapted to deliver lubricant from the downstream opening of the lubricant passage to the drive shaft bearing, and the return passage is adapted to deliver lubricant delivered to the drive shaft bearing to the bevel gear mechanism. In one such embodiment, the bypass passage comprises a pipe extending through an exhaust gas passage defined in the lower casing. In another such embodiment, the bypass passage comprises a communication passage formed in a wall of the lower casing.

In a further embodiment, the lubricant circulation system comprises a first circulation subsystem comprising the lubricant passage formed in the propeller shaft, and a second circulation subsystem adapted to pump lubricant along the drive shaft upwardly from the bevel gear mechanism to a drive shaft bearing. In one such embodiment, the second circulation subsystem additionally comprises a return passage extending from the drive shaft bearing into a shifter passage and to the bevel gear mechanism.

In accordance with another embodiment, a propulsion unit for marine drive is provided. The propulsion unit comprises a drive shaft adapted to be driven by an engine of the marine drive, a bevel gear mechanism chamber enclosing a bevel gear mechanism that connects to a lower portion of the drive shaft and is driven by the drive shaft, a propeller shaft having a first portion that is connected to the bevel gear mechanism and is driven by the drive shaft via the bevel gear mechanism, and a lower casing comprising the bevel gear mechanism chamber. The propeller shaft has a second portion comprising a projection that projects generally rearward from the lower casing. A propeller shaft journal bearing rotatably supports the propeller shaft generally adjacent the propeller shaft projection. A lubricant circulation system is adapted to circulate lubricant between the propeller shaft journal bearing and the bevel gear mechanism chamber. The lubricant circulation system comprises a lubricant delivery passage comprising a first passage portion extending axially within the propeller shaft from an upstream opening defined in the bevel gear mechanism chamber to an axial terminus proximate to the propeller shaft bearing, and a second passage portion extending generally radially within the propeller shaft from the axial terminus to a downstream opening at or adjacent the propeller shaft journal bearing. As such, the lubricant circulation system circulates lubricant from the bevel gear mechanism chamber to the propeller shaft journal bearing.

DETAILED DESCRIPTION OF PREFERRED EMBODIMENTS

Preferred embodiments of the present invention will be described hereinafter with reference to the accompanying drawings.

Figure 1:
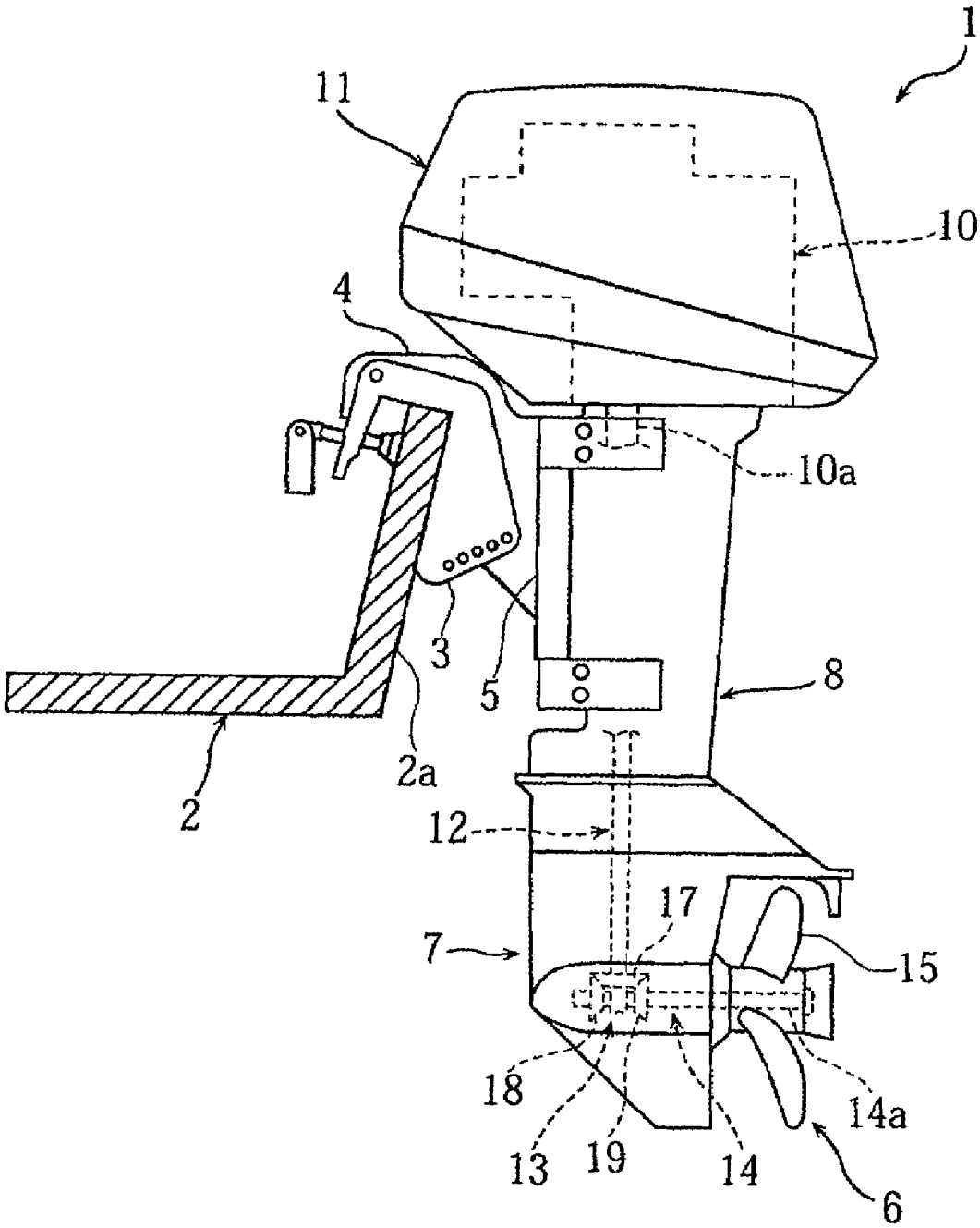
FIG. 1 is a side view of an outboard motor in accordance with a first embodiment of the present invention.
Figure 2:
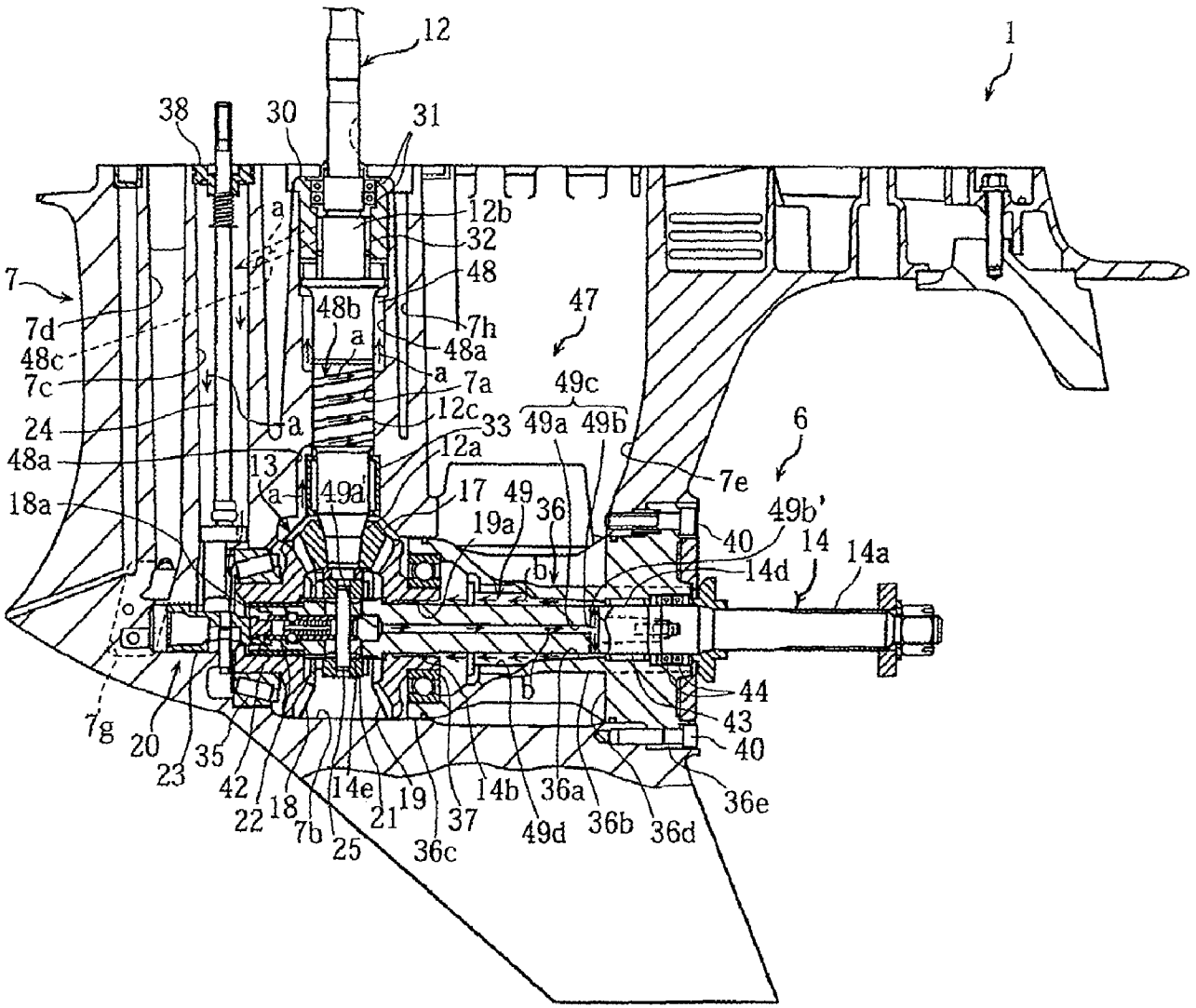
FIG. 2 is a cross sectional view of a propulsion unit for the outboard motor shown in FIG. 1.

FIGS. 1 and 2 illustrate an example propulsion unit for an outboard motor in accordance with one embodiment. FIG. 1 is a side view of an outboard motor on a hull, and FIG. 2 is a cross sectional view of a propulsion unit for an outboard motor.

In the figures, an outboard motor 1 is mounted at the stern 2*a* of a hull 2. The outboard motor 1 has a clamp bracket 3 secured to the stern 2*a* and includes a swivel arm 4 and a pivot shaft 5. The swivel arm 4 supports the outboard motor 1 for up-and-down pivotal movement. The pivot shaft 5 supports the outboard motor 1 in a manner to steer to the left and right.

The external structure of the outboard motor 1 generally includes a lower casing 7, an upper casing 8, and a cowling 11. The lower casing 7 has a propulsion unit 6 enclosed therein. The upper casing 8 is coupled to the top of the lower casing 7. On the top of the upper casing 8, an engine 10 is mounted. Preferably, the cowling 11 is attached so as to surround the engine 10. The engine 10 preferably is positioned vertically such that the crankshaft 10*a* is oriented generally vertically when the watercraft is driven on water.

In the illustrated embodiment, the propulsion unit 6 includes a drive shaft 12, a propeller shaft 14, the above-described lower casing 7, and a propeller 15. The drive shaft 12 is coaxially coupled to the crankshaft 10*a* and is rotationally driven by the engine 10. The propeller shaft 14 is positioned generally horizontally to be perpendicular to the drive shaft 12, and is rotationally driven thereby via a bevel gear mechanism 13. The lower casing 7 holds therein the propeller shaft 14 and the drive shaft 12. The propeller 15 is attached to a projection 14*a* of the propeller shaft 14 that projects rearward from the lower casing 7.

The illustrated bevel gear mechanism 13 includes a drive bevel gear 17, a forward bevel gear 18, and a reverse bevel gear 19. The drive bevel gear 17 is attached to a lower end 12*a* (bevel gear mechanism attachment part) of the drive shaft 12 for rotation therewith. The forward bevel gear 18 and the reverse bevel gear 19 are in constant mesh with the drive bevel gear 17, and are attached to a front end 14*b* (bevel gear mechanism attachment part) of the propeller shaft 14 for rotation relative thereto.

The bevel gear mechanism 13 preferably includes a forward-reverse switching mechanism 20. The forward-reverse switching mechanism 20 includes a dog clutch 21, a shift sleeve 22, a shift shaft 24, and a shift lever (not shown). The dog clutch 21 is positioned between the forward and reverse bevel gears 18, 19 on the propeller shaft 14, and spline fitted over the propeller shaft 14 to move axially therealong and to rotate together therewith. The shift sleeve 22 is axially slidably inserted into the front end 14*b* of the propeller shaft 14. The shift shaft 24 is coupled to the shift sleeve 22 via a shift cam 23. The shift lever (not shown) is coupled to the shift shaft 24 and positioned on the hull 2. The shift sleeve 22 is coupled to the dog clutch 21 with a pin 25. The pin 25 is disposed through a pin hole 14*e* formed in the propeller shaft 14 between the forward and reverse bevel gears 18, 19.

The dog clutch 21 is movable between a neutral position and forward and reverse clutch-in positions. In the neutral position, the dog clutch does not engage with the forward bevel gear 18 nor the reverse bevel gear 19. In the forward and reverse clutch-in positions, the dog clutch engages with the forward or reverse bevel gear 18, 19.

As the operator operates the shift lever from the neutral position to the forward or reverse clutch-in position, the shift shaft 24 will rotate to cause the shift cam 23 to convert the rotation of the shift shaft 24 to the axial movement of the shift sleeve 22. Accordingly, the dog clutch 21 will be brought into engagement with the forward or reverse bevel gear 18, 19. As a result, the rotational force of the drive shaft 12 will be transmitted to the propeller shaft 14.

The illustrated lower casing 7 is generally bullet-shaped as viewed in a cross sectional view perpendicular to the drive shaft 12. In the lower casing 7 at a generally central portion in the fore-and-aft direction, a drive shaft chamber 7*a* is defined which extends vertically and is open upward. In the drive shaft chamber 7*a*, the drive shaft 12 is enclosed.

The illustrated lower casing 7 also has a bevel gear mechanism chamber 7*b* defined therein which is positioned at the lower end of the drive shaft chamber 7*a*. The bevel gear mechanism chamber 7*b* extends in the fore-and-aft direction and is open rearward. In the bevel gear mechanism chamber 7*b*, the bevel gear mechanism 13 is enclosed.

A cylindrical bearing housing 30 is mounted within an upper end opening of the drive shaft chamber 7*a* to seal between the drive shaft 12 and the inner peripheral wall of the drive shaft chamber 7*a* oil. In the bearing housing 30, there are disposed a pair of upper and lower seals 31, 31 for sealing between the housing 30 and the drive shaft 12 oil.

An upper end 12*b* of the drive shaft 12 in the lower casing 7 is rotatably supported by the housing 30 via a needle bearing 32. A lower end 12*a* of the drive shaft 12 is rotatably supported by a needle bearing 33 disposed within a lower end opening of the drive shaft chamber 7*a*.

In the bevel gear mechanism chamber 7*b* at its front end, a conical roller bearing 35 is disposed for rotatably supporting the forward bevel gear 18. Within a rear end opening of the bevel gear mechanism chamber 7*b*, a ball bearing 37 is disposed for rotatably supporting the reverse bevel gear 19 via a gear housing 36 (to be described later).

The illustrated lower casing 7 also has a shift shaft chamber 7*c* defined therein. The shift shaft chamber 7*c* is positioned in front of the drive shaft chamber 7*a* and extends parallel to the drive shaft chamber 7*a*. In the shift shaft chamber 7*c*, the shift shaft 24 is enclosed. A lower end of the shift shaft chamber 7*c* communicates with the bevel gear mechanism chamber 7*b*. A seal 38 is mounted within an upper end opening of the shift shaft chamber 7*c* to seal between the shift shaft 24 and the inner peripheral wall of the shift shaft chamber 7*c*.

The illustrated lower casing 7 has a cooling water intake passage 7*d* defined therein. The cooling water intake passage 7*d* is positioned in front of the shift shaft chamber 7*c* and extends generally parallel to the shift shaft chamber 7*c*. The cooling water intake passage 7*d* is designed to direct cooling water flow therethrough which enters through inlets 7*g* formed in left and right sidewalls of the lower casing 7.

The illustrated lower casing 7 has a cooling water jacket 7*h* defined therein which surrounds the drive shaft chamber 7*a*. The cooling water flowing through the cooling jacket 7*h* will cool the lubricant in the drive shaft chamber 7*a*. The lubricant in the shift shaft chamber 7*c* will also be cooled by the cooling water flowing through the cooling water intake passage 7*d* and the cooling water jacket 7*h*.

The illustrated lower casing 7 also has an exhaust gas passage 7*e* defined therein which is positioned behind the drive shaft chamber 7*a*. The cooling water jacket 7*h* is positioned between the exhaust gas passage 7*e* and the drive shaft chamber 7*a*. The exhaust gas passage 7*e* communicates with a discharge opening (not shown) formed in the rear end face of the lower casing 7. The exhaust gas from the engine 10 will flow through the upper casing 7 and through the passage 7*e* to be discharged through the discharge opening into water.

In the bevel gear mechanism chamber 7*b* of the illustrated lower casing 7, the gear housing 36 described above is inserted so as to extend across the exhaust gas passage 7*e*. The gear housing 36 defines the exhaust gas passage 7*e* and the bevel gear mechanism chamber 7*b*.

The gear housing 36 includes a cylindrical portion 36*b*, a large-diameter portion 36*c*, a plurality of ribs 36*d*, and a flange 36*e*. The cylindrical portion 36*b* has a propeller shaft bore 36*a* disposed therethrough. The large-diameter portion 36*c* is cup-shaped and is formed at a front end of the cylindrical portion 36*b*. The ribs 36*d* are formed at a rear end of the cylindrical portion 36*b* to extend radially outward perpendicularly to the axial direction thereof. The flange 36*e* is formed on peripheral ends of the ribs 36*d*. The flange 36*e* is secured to the peripheral edge of the discharge opening in the lower casing 7 with a plurality of bolts 40 inserted from behind.

The outer periphery of the large-diameter portion 36*c* preferably is mounted within the rear end opening of the bevel gear mechanism chamber 7*b* oil. The ball bearing 37 is mounted between the inner periphery of the large-diameter portion 36*c* and a boss of the reverse bevel gear 19.

The propeller shaft 14 is disposed through the propeller shaft bore 36*a* of the gear housing 36. The front end 14*b* of the propeller shaft 14 is inserted through a shaft bore 19*a* of the reverse bevel gear 19 and into the shaft bore 18*a* of the forward bevel gear 18. The front end 14*b* is supported by the forward and reverse bevel gears 18, 19 for rotation relative thereto, via a metal bearing 42 which is disposed within the shaft bore 18*a* of the forward bevel gear 18. The propeller shaft 14 and the shaft bore 19*a* of the reverse bevel gear 19 form a gap therebetween.

At a rear end of the propeller shaft bore 36*a* of the gear housing 36, there is disposed a pair of front and rear seals 44, 44 for sealing between the propeller shaft 14 and the gear housing 36 oil.

In the propeller shaft bore 36*a* of the gear housing 36 and just in front of the seals 44, a needle bearing 43 preferably is disposed for rotatably supporting a rear end 14*d* of the propeller shaft 14.

The propulsion unit 6 includes an oil circulating system 47 which circulates lubricant in the lower casing 7. In the illustrated oil circulating system 47, the lubricant circulates through the drive shaft chamber 7*a*, the bevel gear mechanism chamber 7*b*, the shift shaft chamber 7*c*, and the propeller shaft bore 36*a*. The oil level of the lubricant preferably is positioned at about the upper needle bearing 32 in the drive shaft chamber 7*a*. The oil level preferably is also positioned at about the same height in the shift shaft chamber 7*c*.

In the illustrated embodiment, the oil circulating system 47 includes a drive shaft circulating system 48 and a propeller shaft circulating system 49. The drive shaft circulating system 48 circulates a first part "a" of the lubricant therein to flow from a drive bevel gear attachment part of the drive shaft 12 through the upper and lower needle bearings 32, 33 to the forward-reverse switching mechanism 20. The propeller shaft circulating system 49 circulates a second part "b" of the lubricant therein to flow from the forward and reverse bevel gears attachment part 14*b* of the propeller shaft 14 to the needle bearing 43.

The drive shaft circulating system 48 preferably includes an oil passage 48*a*, a screw pump 48*b*, and a return passage 48*c*. The oil passage 48*a* is formed by a gap between the drive shaft 12 and the inner peripheral wall of the drive shaft chamber 7*a* in the lower casing 7, and extends axially along the drive shaft 12. The screw pump 48*b* is formed by a gap between an axial central portion of the drive shaft 12 in the lower casing and the inner peripheral wall of the drive shaft chamber 7*a*. The return passage 48*c* communicates a part of an upper end of the oil passage 48*a* around the needle bearing 32 and the shift shaft chamber 7*c*.

The drive shaft 12 in the lower casing 7 has a spiral groove 12*c* formed in the periphery thereof which extends upward in a clockwise direction. The screw pump 48*b* is obtained by providing a slight gap between the spiral groove 12*c* and the inner peripheral wall of the drive shaft chamber 7*a*. The screw pump 48*b* pressurizes and delivers upward the first part "a" of the lubricant in the oil passage 48*a*.

As the drive shaft 12 rotates, the screw pump 48*b* pressurizes and delivers the first part of the lubricant upward through the oil passage 48*a*. The first part "a" of the lubricant rising through the oil passage 48*a* lubricates the needle bearing 32. From the needle bearing 32, the first part "a" flows through the return passage 48*c* into the shift shaft chamber 7*c*. It then lubricates sliding parts of the forward-reverse switching mechanism 20 and the conical roller bearing 35 and then returns to the bevel gear mechanism chamber 7*b*. The first part "a" of the lubricant in the bevel gear mechanism chamber 7*b* is again delivered upward by the screw pump 48*b* while lubricating meshing parts of the bevel gear mechanism 13 and the lower needle bearing 33.

The first part "a" flowing through the drive shaft chamber 7*a* and the shift shaft chamber 7*c* is cooled by the cooling water flowing through the cooling water jacket 7*h*.

The propeller shaft circulating system 49 preferably includes an oil passage 49*c* and a return passage 49*d*. The oil passage 49*c* includes an axial passage 49*a* and a vertical passage 49*b*. In the illustrated embodiment the axial passage 49*a* is disposed in the propeller shaft 14 and extends axially therealong from the forward and reverse bevel gears attachment part (front end) 14*b* to a position proximate to the needle bearing 43. The vertical passage 49*b* extends radially from an extended end of the axial passage 49*a* and communicates with an area proximate to the needle bearing 43. The return passage 49*d* is formed by a gap between the propeller shaft 14 and the inner peripheral wall of the propeller shaft bore 36*a* of the gear housing 36.

The axial passage 49*a* of the oil passage 49*c* preferably has an upstream opening 49*a*' communicating with the pin hole 14*e* of the propeller shaft 14 between the forward and reverse bevel gears 18, 19. The vertical passage 49*b* has a downstream opening 49*b*' communicating with an area proximate to a front part of the needle bearing 43.

As the dog clutch 21 engages with the forward or reverse bevel gear 18, 19 in response to the operator's operation of the shift lever, the propeller shaft 14 will start rotation. At this time, the second part "b" of the lubricant will be forced out through the vertical passage 49*b* of the oil passage 49*c* by centrifugal force due to the rotation of the propeller shaft 14. The forced-out second part "b" will lubricate the needle bearing 43 and then flow through the return passage 49*d* to lubricate the ball bearing 37 and the meshing parts of the bevel gear mechanism 13, and then return to the bevel gear mechanism chamber 7*b*. The second part "b" of the lubricant in the bevel gear mechanism chamber 7*b* will enter the axial passage 49*a* of the oil passage 49*c*, drawn by the rotation of the propeller shaft 14. The second part "b" flowing through the propeller shaft circulating system 49 will be cooled by the water which will flow along the outside surface of the lower casing 7.

In the illustrated embodiment, the oil passage 49*c* is formed including the axial passage 49*a* and the vertical passage 49*b*. The axial passage 49*a* is disposed in the propeller shaft 14 and extends axially therealong from a front end face of the propeller shaft 14 through the bevel gear mechanism attachment part 14*b* to a position proximate to the needle bearing 43. The vertical passage 49*b* radially extends from a rear end of the axial passage 49*a* and communicates with the area proximate to the front part of the needle bearing 43. The second part "b" of the lubricant can thus circulate between the bevel gear mechanism attachment part 14*b* and the needle bearing 43 through the oil passage 49*c*. Accordingly, as the propeller shaft 14 rotates, the second part "b" will be forced out through the downstream opening of the oil passage 49*c* by centrifugal force. The forced-out second part "b" will lubricate the needle bearing 43 of the propeller shaft 14 and then flow to the bevel gear mechanism attachment part 14*b* to lubricate the meshing parts of the bevel gear mechanism 13. It will then return from the bevel gear mechanism chamber 7*b* to the oil passage 49*c*. The second part "b" can thus circulate in the lower casing to lubricate both the meshing parts of the bevel gear mechanism 13 and the needle bearing 43. As a result, less wear occurs to the bevel gear mechanism 13 and the bearing 43, providing the prolonged life of the parts.

The oil passage 49*c* in accordance with this embodiment includes the axial passage 49*a* and the vertical passage 49*b*, which are formed in the propeller shaft 14. As a result, the propeller shaft circulating system 49 can be formed with a simple structure and without increasing the lower casing 7 in size.

In this embodiment, the return passage 49*d* is formed by the gap between the propeller shaft 14 and the inner peripheral wall of the propeller shaft bore 36*a* of the gear housing 36, which rotatably supports the propeller shaft 14. The return passage 49*d* is adapted to return the second part "b" of the lubricant which flows out through the downstream opening of the oil passage 49*c* to the bevel gear mechanism attachment part 14*b*. Thus, the gap between the propeller shaft 14 and the inner peripheral wall of the propeller shaft bore 36*a* can be utilized to circulate the second part "b" of the lubricant. As a result, the propeller shaft circulating system 49 can be formed with a simple structure and at a low cost without increasing the lower casing 7 in size.

Figure 3:
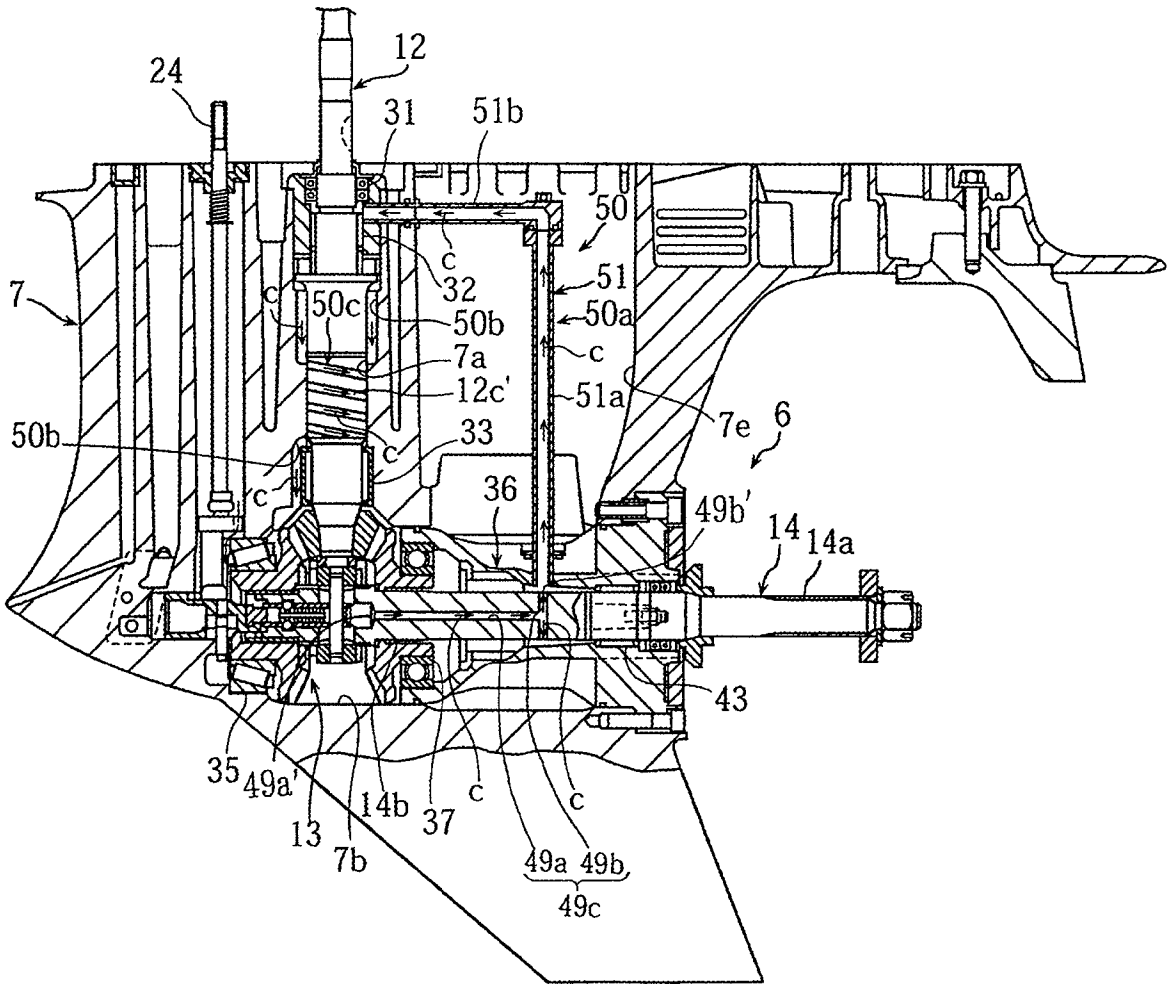
FIG. 3 is a cross sectional view of a propulsion unit in accordance with a second embodiment of the present invention.

FIG. 3 illustrates a propulsion unit for an outboard motor in accordance with another embodiment. In the figure, the same reference numerals as those in FIG. 2 show the same parts or equivalent parts.

The propulsion unit in accordance with this embodiment includes an oil circulating system 50. The oil circulating system 50 includes an oil passage 49*c* formed in the propeller shaft 14. The oil passage 49*c* extends axially along a propeller shaft 14 from a bevel gear mechanism attachment part 14*b* thereof to a position proximate to a needle bearing 43 for rotatably supporting a rear end of the propeller shaft 14. The oil circulating system 50 circulates lubricant "c" between the needle bearing 43 and the bevel gear mechanism attachment part 14*b*.

The oil circulating system 50 includes a bypass passage 50*a*, a return passage 50*b*, and a screw pump 50*c*. The bypass passage 50*a* is adapted to deliver the lubricant "c" forced out through a downstream opening 49*b*' of the oil passage 49*c* by centrifugal force due to the rotation of the propeller shaft 14, to an upper needle bearing 32 of a drive shaft 12. The return passage 50*b* is adapted to return the lubricant "c" delivered to the needle bearing 32, to a lower needle bearing 33 of the drive shaft 12 and a bevel gear mechanism 13. The screw pump 50*c* delivers the lubricant "c" in the return passage 50*b* downward.

The drive shaft 12 in a lower casing 7 has a spiral groove 12*c*' formed in the periphery thereof which extends downward in a clockwise direction. The screw pump 50*c* is obtained by providing a slight gap between the spiral groove 12*c*' and the inner peripheral wall of a drive shaft chamber 7*a*. The screw pump 50*c* pressurizes and delivers the lubricant "c" downward.

The bypass passage 50*a* preferably is constituted from a metal pipe 51 positioned to extend through the space defined by an exhaust gas passage 7*e* in the lower casing 7.

The illustrated pipe 51 includes a vertical pipe 51*a* and a horizontal pipe 51*b*. The vertical pipe 51*a* penetrates the gear housing 36 and communicates with the downstream opening 49*b*' of the oil passage 49*c*. The vertical pipe 51*a* extends vertically upward and parallel to the drive shaft 12. The horizontal pipe 51*b* is connected to an upper end of the vertical pipe 51*a* and extends in a direction perpendicular to the drive shaft 12. The horizontal pipe 51*b* communicates with the upper needle bearing 32 above the drive shaft chamber 7*a*.

As the dog clutch 21 engages with the forward or reverse bevel gear 18, 19 in response to the operator's operation of the shift lever, the propeller shaft 14 will start rotation. At this time, the lubricant "c" will be forced out through the downstream opening 49*b*' of the oil passage 49*c* by centrifugal force due to the rotation of the propeller shaft 14. The forced-out lubricant "c" will lubricate the needle bearing 43 and then flow into the bypass passage 50*a* to lubricate the upper needle bearing 32 of the drive shaft 12. The lubricant "c" that lubricated the needle bearing 32 will be pressurized and delivered downward through the oil passage 50*b* by the screw pump 50*c*. It will then lubricate the lower needle bearing 33, meshing parts of the bevel gear mechanism 13, a conical roller bearing 35, and a ball bearing 37, and return to a bevel gear mechanism chamber 7*b* to flow into the oil passage 49*c* of the propeller shaft 14 again.

In this embodiment, the lubricant "c" forced out through the downstream opening 49*b*' of the oil passage 49*c* is first delivered to the needle bearing 43 at the rear end of the propeller shaft 14. It is then delivered through the bypass passage 50*a* to the needle bearings 32, 33 of the drive shaft 12. From the bearing 33, the lubricant "c" is delivered through the return passage 50*b* to the bevel gear mechanism 13, and then returns to the bevel gear mechanism chamber 7*b*. As a result, the lubricant can circulate in the lower casing 7 to lubricate substantially all the parts to be lubricated, i.e., the meshing parts of the bevel gear mechanism 13, the bearing 43 of the propeller shaft 14, and the upper and lower bearings 32, 33 of the drive shaft 12. This provides the prolonged life of the meshing parts and bearings without increasing the lower casing 7 in size.

In this embodiment, the bypass passage 50*a* is constituted from the pipe 51 positioned in the space defined by the exhaust gas passage 7*e*. Thus, the space within the exhaust gas passage 7*e* can be utilized to form the bypass passage 50*a*.

Figure 4:
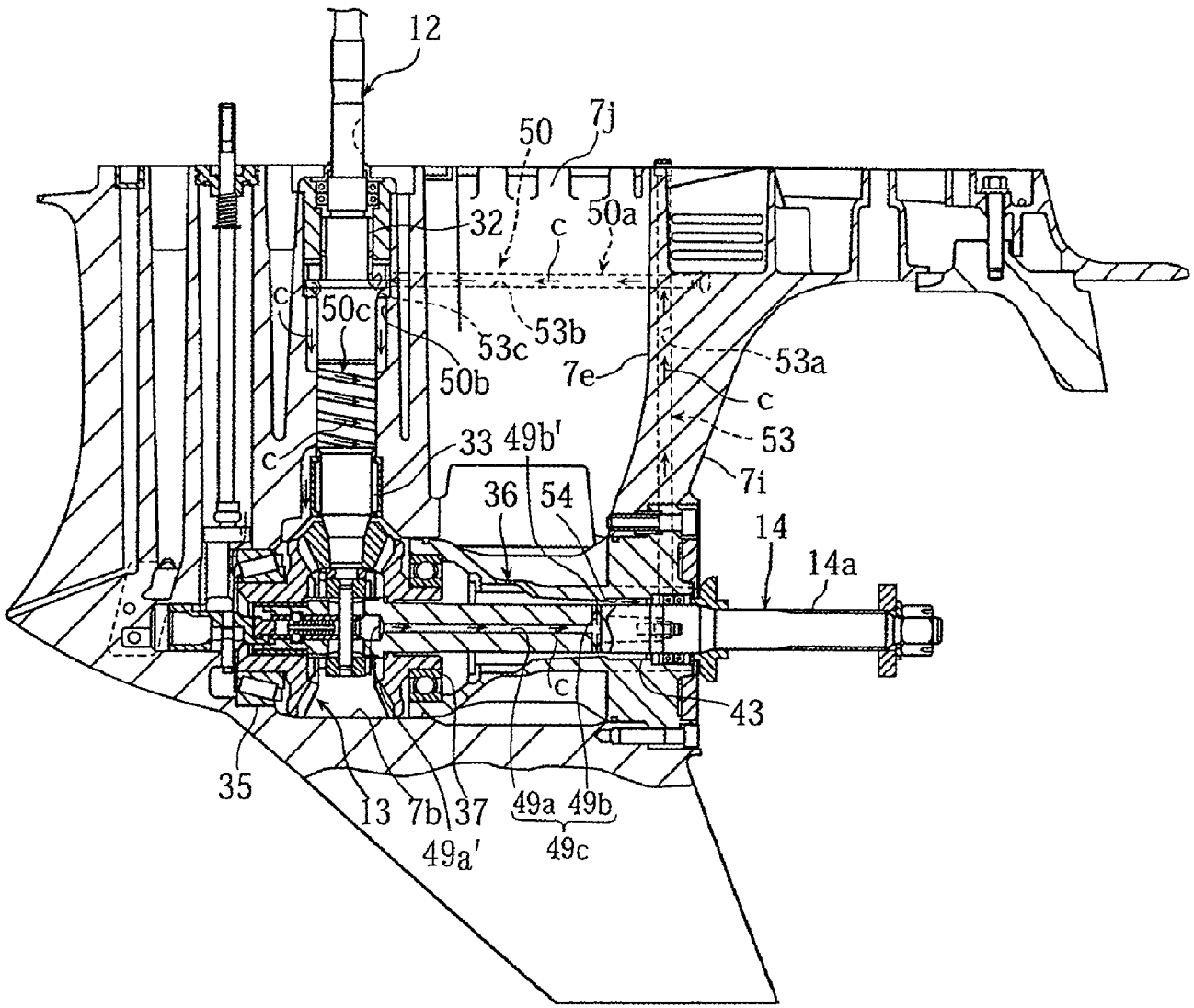
FIG. 4 is a cross sectional view of a propulsion unit in accordance with a third embodiment of the present invention.

FIG. 4 illustrates a propulsion unit for an outboard motor in accordance with yet another embodiment. In the figure, the same reference numerals as those in FIG. 3 show the same parts or equivalent parts.

An oil circulating system 50 in accordance with this embodiment of the present invention includes a bypass passage 50*a*, a return passage 50*b*, and a screw pump 50*c*. The bypass passage 50*a* is adapted to deliver lubricant "c" forced out through a downstream opening 49*b*' of an oil passage 49*c* by centrifugal force due to the rotation of a propeller shaft 14, to an upper needle bearing 32 of a drive shaft 12. The return passage 50*b* is adapted to return the lubricant "c" delivered to the needle bearing 32, to a lower needle bearing 33 of the drive shaft 12 and a bevel gear mechanism 13. The screw pump 50*c* delivers the lubricant "c" in the return passage 50*b* downward. The basic structure of the oil circulating system 50 in accordance with this embodiment is similar to that of the oil circulating system 50 in accordance with the embodiment discussed above in connection with FIG. 3.

In this embodiment, the bypass passage 50*a* is constituted from a communication passage 53 formed in the peripheral wall of an exhaust gas passage 7*e* in a lower casing 7.

The propeller shaft 14 and a gear housing 36 form an oil passage 54 therebetween which passes outside of the needle bearing 43 and extends to a position proximate to seals 44.

The illustrated communication passage 53 includes a first communication passage 53*a*, a second communication passage 53*b*, and a third communication passage 53*c*. The first communication passage 53*a* communicates with the oil passage 54. From the oil passage 54, the first communication passage 53*a* extends vertically upward through a rib 36*d* of the gear housing 36 and through a rear wall 7*i* of the exhaust gas passage 7*e* in the lower casing 7. The second communication passage 53*b* extends from an upper end of the first communication passage 53*a* forward through a sidewall 7*j* of the exhaust gas passage 7*e*. The third communication passage 53*c* extends laterally inward from a front end of the second communication passage 53*b* and communicates with the return passage 50*b* below the needle bearing 32.

As the propeller shaft 14 rotates, the lubricant "c" will be forced out through the downstream opening 49*b*' of the oil passage 49*c* by centrifugal force. The forced-out lubricant "c" will pass through the oil passage 54 and then lubricate the needle bearing 43. It will then flow into the bypass passage 50*a* and then lubricate the upper needle bearing 32 of the drive shaft 12. The lubricant "c" that lubricated the needle bearing 32 will be pressurized and delivered downward through the return passage 50*b* by the screw pump 50*c*. It will then lubricate the lower needle bearing 33, meshing parts of the bevel gear mechanism 13, a conical roller bearing 35, and a ball bearing 37, and return to a bevel gear mechanism chamber 7*b* to flow into the oil passage 49*c* of the propeller shaft 14.

In this embodiment, the lubricant can circulate in the lower casing 7 to lubricate substantially all the parts to be lubricated therein. This provides the prolonged life of the meshing parts and bearings without increasing the lower casing 7 in size. Accordingly, the same effect as in the second embodiment is obtained in this embodiment.

In this embodiment, the bypass passage 50*a* is constituted from the communication passage 53 formed in the walls 7*i*, 7*j* of the exhaust gas passage 7*e* in the lower casing 7. Thus, the walls 7*i*, 7*j* can be utilized to form the bypass passage 50*a*, which avoids possible influence of exhaust gas.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. For example, although the illustrated embodiments show an outboard motor, other types of marine drives, such as stern drives, could benefit from the principles disclosed herein. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising an engine and a propulsion unit, the propulsion unit comprising a drive shaft driven by the engine, a bevel gear mechanism, a propeller shaft driven by the drive shaft via the bevel gear mechanism, a lower casing adapted to support the propeller shaft, bevel gear mechanism, and drive shaft, the propeller shaft having a projection projecting generally rearward from the lower casing, a propeller shaft bearing for rotatably supporting the propeller shaft generally proximate the propeller shaft projection, and a lubricant circulation system adapted to circulate lubricant between the propeller shaft bearing and the bevel gear mechanism, the lubricant circulation system comprising a lubricant passage extending axially within the propeller shaft from a bevel gear mechanism attachment part of the propeller shaft to an axial terminus proximate to the propeller shaft bearing, the lubricant passage further extending radially within the propeller shaft from the axial terminus to a downstream opening at or adjacent the propeller shaft bearing, wherein the lubricant circulation system is adapted to circulate lubricant through the lubricant passage from the bevel gear mechanism to the propeller shaft bearing, wherein an upstream opening of the lubricant passage is provided in the bevel gear mechanism attachment part of the propeller shaft, and wherein the lubricant circulation system additionally comprises a return passage formed in a gap between the propeller shaft and an inner peripheral wall of a propeller shaft bore in the lower casing and extending from the downstream opening of the lubricant passage to the bevel gear mechanism attachment part.

2. An outboard motor as in claim 1, wherein the bevel gear mechanism comprises a forward bevel gear and a reverse bevel gear, each gear being attached to the propeller shaft, and the upstream opening of the lubricant passage communicates with an area between the forward and reverse bevel gears in the propeller shaft.

3. An outboard motor comprising an engine and a propulsion unit, the propulsion unit comprising a drive shaft driven by the engine, a bevel gear mechanism, a propeller shaft driven by the drive shaft via the bevel gear mechanism, a lower casing adapted to support the propeller shaft, bevel gear mechanism, and drive shaft, the propeller shaft having a projection projecting generally rearward from the lower casing, a propeller shaft bearing for rotatably supporting the propeller shaft generally proximate the propeller shaft projection, and a lubricant circulation system adapted to circulate lubricant between the propeller shaft beam and the bevel gear mechanism, the lubricant circulation system comprising a lubricant passage extending axially within the propeller shaft from a bevel gear mechanism attachment part of the propeller shaft to an axial terminus proximate to the propeller shaft bearing, the lubricant passage further extending radially within the propeller shaft from the axial terminus to a downstream opening at or adjacent the propeller shaft bearing, wherein the lubricant circulation system is adapted to circulate lubricant through the lubricant passage from the bevel gear mechanism to the propeller shaft bearing, wherein an upstream opening of the lubricant passage is provided in the bevel gear mechanism attachment part of the propeller shaft, the outboard motor also comprising a drive shaft bearing for rotatably supporting the drive shaft, and wherein the lubricant circulation system further comprises a bypass passage and a return passage, wherein the bypass passage is adapted to deliver lubricant from the downstream opening of the lubricant passage to the drive shaft bearing, and the return passage is adapted to deliver lubricant delivered to the drive shaft bearing to the bevel gear mechanism.

4. An outboard motor as in claim 3, wherein the bypass passage comprises a pipe extending through an exhaust gas passage defined in the lower casing.

5. An outboard motor as in claim 3, wherein the bypass passage comprises a communication passage formed in a wall of the lower casing.

6. An outboard motor as in claim 1, wherein the lubricant circulation system comprises a first circulation subsystem comprising the lubricant passage formed in the propeller shaft, and a second circulation subsystem adapted to pump lubricant along the drive shaft upwardly from the bevel gear mechanism to a drive shaft bearing.

7. An outboard motor as in claim 6, wherein the second circulation subsystem additionally comprises a return passage extending from the drive shaft bearing into a shifter passage and to the bevel gear mechanism.

8. A propulsion unit for a marine drive, comprising a drive shaft adapted to be driven by an engine of the marine drive, a bevel gear mechanism chamber enclosing a bevel gear mechanism that connects to a lower portion of the drive shaft and is driven by the drive shaft, a propeller shaft having a first portion that is connected to the bevel gear mechanism and is driven by the drive shaft via the bevel gear mechanism, a lower casing comprising the bevel gear mechanism chamber, the propeller shaft having a second portion comprising a projection that projects generally rearward from the lower casing, a propeller shaft journal bearing for rotatably supporting the propeller shaft generally adjacent the propeller shaft projection, and a lubricant circulation system adapted to circulate lubricant between the propeller shaft journal bearing and the bevel gear mechanism chamber, the lubricant circulation system comprising a lubricant delivery passage comprising a first passage portion extending axially within the propeller shaft from an upstream opening defined in the bevel gear mechanism chamber to an axial terminus proximate to the propeller shaft bearing, and a second passage portion extending generally radially within the propeller shaft from the axial terminus to a downstream opening at or adjacent the propeller shaft journal bearing, wherein the lubricant circulation system circulates lubricant from the bevel gear mechanism chamber to the propeller shaft journal bearing, wherein the lubricant circulation system additionally comprises a return passage formed in a gap between the propeller shaft and an inner peripheral wall of a propeller shaft bore in the lower casing and extending from the downstream opening of the lubricant delivery passage to the bevel gear mechanism chamber.

9. A propulsion unit as in claim 8 additionally comprising a drive shaft journal bearing for rotatably supporting the drive shaft, and wherein the lubricant circulation system further comprises a bypass passage and a return passage, wherein the bypass passage is adapted to deliver lubricant from the downstream opening of the lubricant delivery passage to the drive shaft journal bearing, and the return passage is adapted to deliver lubricant delivered to the drive shaft journal bearing to the bevel gear mechanism chamber.

10. A propulsion unit as in claim 9, wherein the bypass passage comprises a pipe extending through an exhaust gas passage defined in the lower casing.

11. A propulsion unit as in claim 9, wherein the bypass passage comprises a communication passage formed in a wall of the lower casing.

12. A propulsion unit as in claim 8, wherein the lubricant circulation system comprises a first circulation subsystem comprising the lubricant delivery passage formed in the propeller shaft, and a second circulation subsystem adapted to pump lubricant along the drive shaft upwardly from the bevel gear mechanism to a drive shaft journal bearing.

13. A propulsion unit as in claim 12, wherein the second circulation subsystem additionally comprises a return passage extending from the drive shaft journal bearing into a shifter passage and to the bevel gear mechanism chamber.

* * * * *

UNITED STATES PATENT AND TRADEMARK OFFICE

CERTIFICATE OF CORRECTION

PATENT NO. : 7,494,391 B2
APPLICATION NO. : 11/771842
DATED : February 24, 2009
INVENTOR(S) : Yoshihiko Okabe It is certified that error appears in the above-identified patent and that said Letters Patent is hereby corrected as shown below:

In column 11, line 2, in Claim 3, change "beam" to --bearing--.

Signed and Sealed this

Fourth Day of May, 2010

David J. Kappos

David J. Kappos
*Director of the United States Patent and Trademark Office*